US007322060B2

(12) United States Patent
Kirn

(10) Patent No.: US 7,322,060 B2
(45) Date of Patent: Jan. 29, 2008

(54) SURGICAL ARM SUPPORT LOCKING MECHANISM AND APPARATUS

(75) Inventor: David S. Kirn, Lexington, KY (US)

(73) Assignee: Channel Products, L.L.C., Lexington, KY (US)

( * ) Notice: Subject to any disclaimer, the term of this patent is extended or adjusted under 35 U.S.C. 154(b) by 0 days.

(21) Appl. No.: 11/566,427

(22) Filed: Dec. 4, 2006

(65) Prior Publication Data

US 2007/0124863 A1 Jun. 7, 2007

Related U.S. Application Data

(60) Provisional application No. 60/741,636, filed on Dec. 2, 2005.

(51) Int. Cl.
*A61G 13/12* (2006.01)
*A61G 7/075* (2006.01)
*A47C 7/54* (2006.01)

(52) U.S. Cl. ..... 5/623; 5/646; 297/411.35

(58) Field of Classification Search ..... 5/621–624, 5/646–651; 248/291.1, 292.12; 297/411.35
See application file for complete search history.

(56) References Cited

U.S. PATENT DOCUMENTS

| | | | | |
|---|---|---|---|---|
| 2,200,541 | A | 5/1940 | Chick | |
| 3,099,441 | A | 7/1963 | Ries | |
| 3,124,328 | A | 3/1964 | Kortsch | |
| 3,227,440 | A | 1/1966 | Scott | |
| 4,196,821 | A * | 4/1980 | Teti et al. | 220/756 |
| 4,444,381 | A | 4/1984 | Wayne | |
| 4,698,837 | A * | 10/1987 | Van Steenburg | 378/208 |
| 4,886,258 | A | 12/1989 | Scott | |
| 4,898,491 | A * | 2/1990 | Van Steenburg | 403/96 |
| 5,135,210 | A * | 8/1992 | Michelson | 5/658 |
| 5,226,187 | A | 7/1993 | Borders et al. | |
| 5,590,934 | A * | 1/1997 | Gibbs | 297/411.38 |
| 5,655,814 | A * | 8/1997 | Gibbs | 297/411.38 |
| 5,740,572 | A | 4/1998 | Hannant | |
| 5,884,976 | A * | 3/1999 | Breen et al. | 297/411.37 |
| 5,918,330 | A | 7/1999 | Navarro et al. | |
| 5,927,811 | A * | 7/1999 | Tseng | 297/353 |
| 5,940,912 | A * | 8/1999 | Keselman et al. | 5/623 |
| 6,086,156 | A * | 7/2000 | Breen et al. | 297/411.37 |
| 6,202,231 | B1 | 3/2001 | Heimbrock et al. | |
| 6,739,006 | B2 | 5/2004 | Borders et al. | |
| 2007/0124863 | A1 * | 6/2007 | Kim | 5/646 |

* cited by examiner

*Primary Examiner*—Robert G. Santos
(74) *Attorney, Agent, or Firm*—King & Schickli, PLLC

(57) ABSTRACT

An apparatus for supporting a patient's arm in a desired position during surgery includes a patient support, such as an surgical table or chair, an arm support for supporting the patient's arm, an arm support locking mechanism for securing the arm support in a desired position during surgery, and a bracket for attaching the arm support and the arm support locking mechanism to the patient support. The arm support locking mechanism includes first and second plates having notches or projections for securing the mechanism in a locked position. One of the plates also has an angled recess region for engaging a wedge-shaped member positioned between the plates in the locked position. In operation, the wedge-shaped member moves one of the plates against a force of the spring to unseat the projections from the notches in an unlocked position allowing for rotation of the arm support in two directions.

20 Claims, 5 Drawing Sheets

SURGICAL ARM SUPPORT LOCKING MECHANISM AND APPARATUS

This application claims the benefit of U.S. Provisional Patent Application Ser. No. 60/741,636, filed Dec. 2, 2005.

TECHNICAL FIELD

The present invention relates generally to surgical tables and chairs having an arm support or armboard attached thereto for supporting a patient's arm during surgery; and more particularly to a surgical table or chair having an arm support locking mechanism for use with an arm support for supporting a patient's arm in a desired position during surgery.

BACKGROUND OF THE INVENTION

Many different surgical table designs with and without attached arm and leg supports are known. Most surgical tables that have arm and leg supports rely on geared or wratchet type locking mechanisms to hold the support in a desired position. Although the surgical table, arm support and locking mechanism provide many of the needs of the surgeon during surgery, the locking mechanism remains difficult to utilize and prone to damage caused by accidental bumping. These shortcomings may hinder the efficiency of the surgeon in the surgical arena and increase the operational costs associated with replacing damaged parts.

Thus, as demonstrated by the limitations and disadvantages of the prior art surgical tables or chairs with attached supports, there is a need identified for an improved apparatus designed to provide all of the benefits associated with ease of movement of the arm support with minimal risk of damage caused by inadvertent bumping of the arm support.

SUMMARY OF THE INVENTION

The present invention meets these needs by providing an improved apparatus for supporting a patient's arm in a desired position during surgery. The apparatus includes a support for a patient, such as a surgical table or chair, an arm support for supporting the patient's arm, an arm support locking mechanism attached to the arm support, and a bracket for attaching the arm support and the arm support locking mechanism to the support for a patient.

In accordance with one aspect of the present invention, the arm support locking mechanism includes a first plate having at least one notch and a second plate having at least one projection adapted to seat in the at least one notch of the first plate in a locked position. One of the first and second plates further has an angled recess region, and one or both plates could have a combination of notches and projections. A wedge-shaped member is positioned between the first and second plates and engages the angled recess region in the locked position. A retention plate is biased against one of the first and second plates by any type of known biasing means or mechanism, such as a spring or clip, and a fastener extends at least partially through the retention plate, the first and second plates, and the wedge-shaped member to hold the arm support locking mechanism together. Movement of the wedge-shaped member moves one of the first and second plates against a force of the biasing mechanism to unseat the at least one projection from the at least one notch in an unlocked position allowing the arm support to rotate.

In accordance with a second aspect of the invention, the arm support may be at least partially curved so as to cradle the patient's arm during surgery. Preferably, the curved arm support provides support for the patient's arm and protection from pressure-related injuries. Since only gravity is required to hold the patient's arm to the arm support regardless of the angle of the surgical table or chair, the need for tapes or straps is eliminated. In addition, the arm support may also be rotatable about an axis substantially coaxial with the patient's arm when the patient's arm is resting on the arm support. Accordingly, the patient may rest supine, semi-erect, or fully erect in a sitting or tilted position while the patient's arm rests comfortably in the curved arm support. Of course, supplemental straps or the like attached to the arm support may be used to help secure the patient's arm while minimizing contact with the arm.

In accordance with a third aspect of the invention, the arm support further includes a base extending longitudinally at least partially along and supporting the arm support, and a release member for moving the wedge-shaped member to unseat the at least one projection from the at least one notch in the unlocked position. Preferably, the base has a channel formed therein for slidably receiving the wedge-shaped member.

In accordance with another aspect of the present invention, a distal end of the at least one projection may be tapered and the at least one aperture may be tapered to receive the tapered distal end of the at least one projection. This allows the at least one projection to unseat from the at least one aperture when a substantial force is applied to the arm support. Advantageously, this prevents damage to the at least one projection when the arm support is accidentally bumped or another substantial force is applied thereto.

Additional advantages, and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

BRIEF DESCRIPTION OF THE DRAWINGS

The accompanying drawings incorporated in and forming a part of the specification, illustrate several aspects of the present invention, and together with the description serve to explain the principles of the invention. In the drawings.

Reference will now be made in detail to the present preferred embodiment of the invention. an example of which is illustrated in the accompanying drawings.

DETAILED DESCRIPTION OF THE PREFERRED EMBODIMENT

Figure 1:
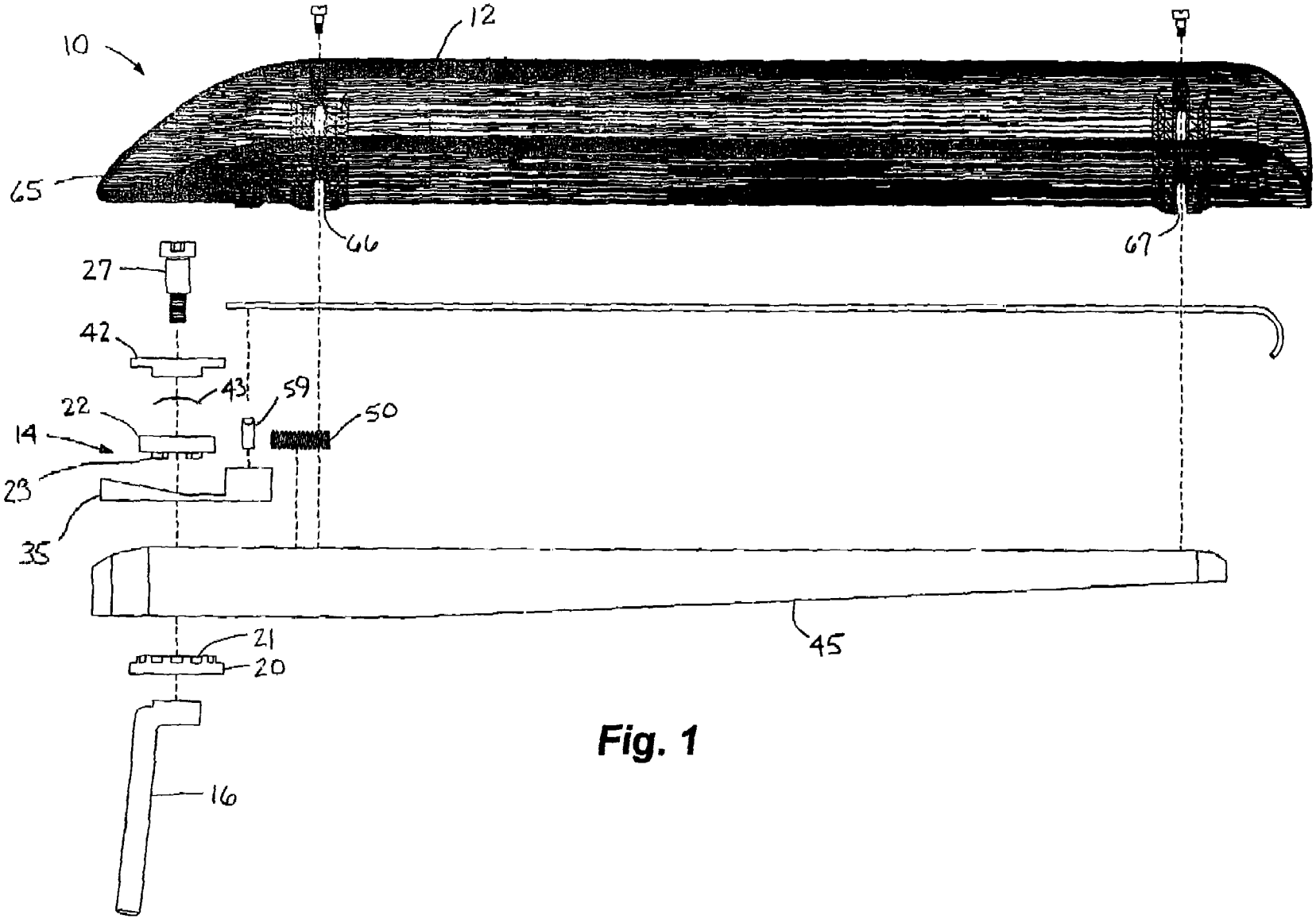
FIG. 1 is an exploded elevation view of an arm support for supporting a patient's arm, an arm support locking mechanism attached to the arm support, and a bracket for attaching the arm support and the arm support locking mechanism to a support for a patient.
Figure 2:
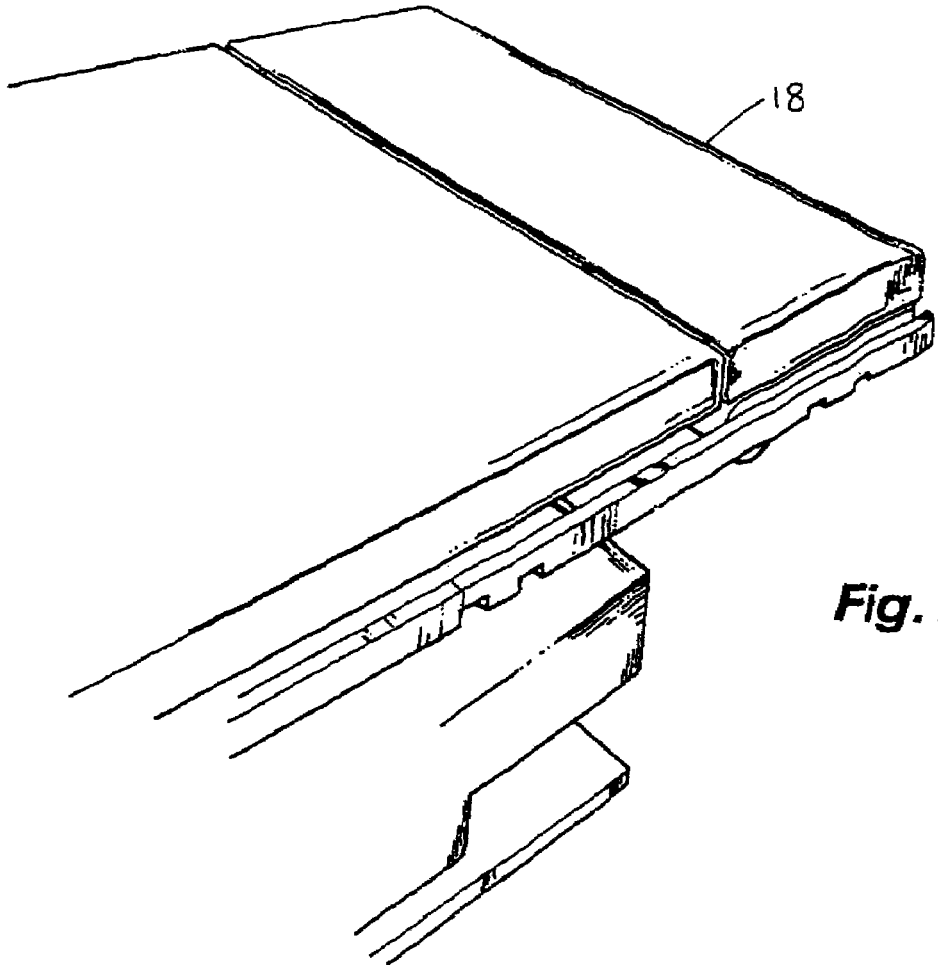
FIG. 2 is a perspective view of a support for a patient in the presently preferred form of a surgical table.

With reference to the exploded view of FIG. 1, there is shown a preferred embodiment of an apparatus 10 for supporting a patient's arm in a desired position during surgery. The apparatus 10 includes an arm support 12 for supporting the patient's arm, an arm support locking mechanism 14 attached to the arm support 12 for securing the arm support 12 in a desired position during surgery, and a bracket 16 for attaching the arm support 12 and the arm support locking mechanism 14 to a patient support (not shown). The patient support can be a surgical table or chair or other similar device. An exemplary surgical table 18 is partially shown in perspective view in FIG. 2 for purposes of illustration only. In accordance with the broadest aspects of the invention, the bracket 16 may be adapted to mate with or be supported by any existing surgical table or chair or other similar device which is known in the art.

Figure 3:
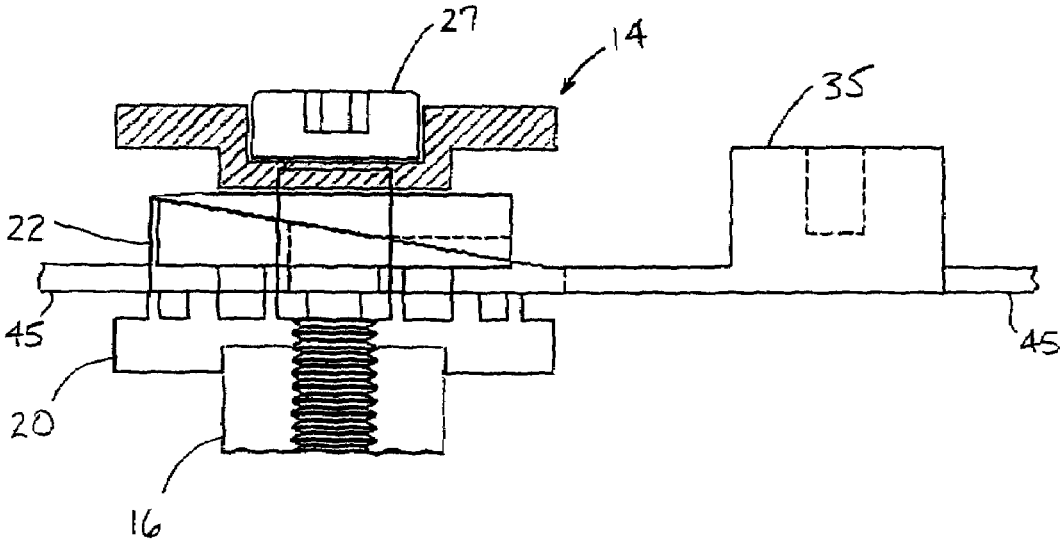
FIG. 3 is a cross-sectional view of the arm support locking mechanism and partial cross-section view of a base of the arm support.
Figure 5:
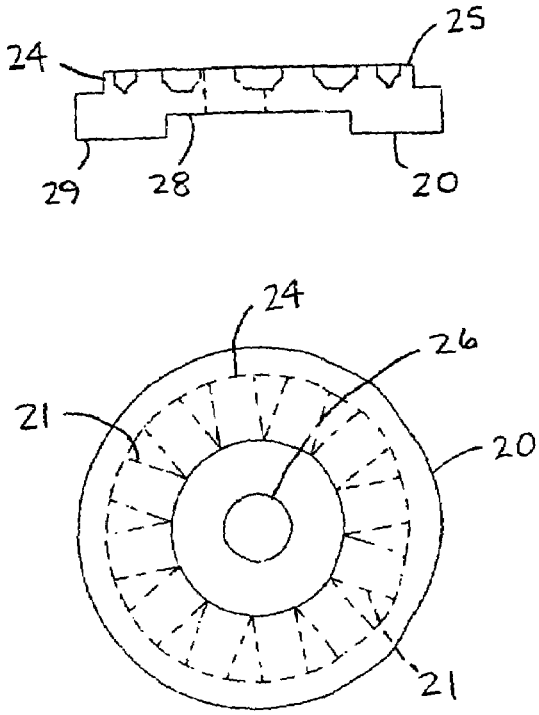
FIG. 5 is a side elevation view and a top view of a second plate of the arm support locking mechanism and twelve tapered notches.
Figure 6:
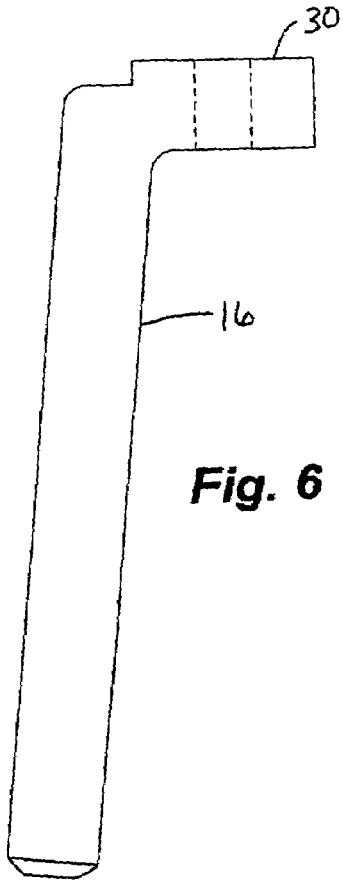
FIG. 6 is a side elevation view of a bracket for attaching the arm support and the arm support locking mechanism to the support for a patient.

The present preferred arm support locking mechanism 14 shown in FIG. 3 includes a first plate 20 having notches 21 therein and a second plate 22 having projections 23 adapted to seat in the notches 21 of the first plate 20 in a locked position. The first plate 20, best shown in FIG. 5, is generally circular in shape and includes twelve radial notches 21 positioned adjacent a perimeter edge 24 on a first side 25 of the plate in the present preferred embodiment. A center aperture 26 is provided for receiving a fastener 27 that secures the arm support locking mechanism 14 together. In addition, a channel 28 or aperture is formed on a second side 29 of the plate for receiving a top side 30 of the bracket 16 as generally shown in FIG. 1.

Figure 4:
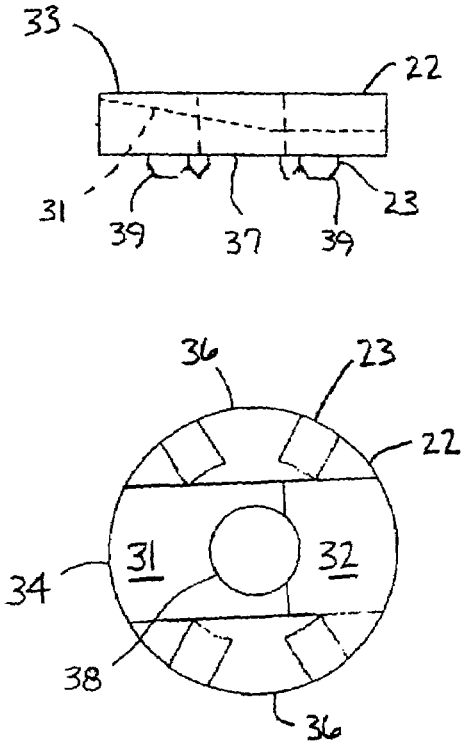
FIG. 4 is a side elevation view and a top view of a first plate of the arm support locking mechanism and four tapered projections.

The second plate 22 is similarly generally circular in shape in the present preferred embodiment. As shown in FIG. 4, the second plate 22 includes four radial projections 23 adapted spatially to mate four of the twelve radial notches 21 of the first plate 20. Depending on the position of the arm support 12, the four radial projections 23 may mate any four of the twelve radial notches 21. In accordance with the broad teaching of the present invention, any number of notches 21 and projections 23 may be used with the same or similar effect. An angled recess region 31 extends from a substantially flat recess region 32 on a first side 33 of the plate 22 to a first edge 34 of the plate for receiving a wedge-shaped member 35. In accordance with an important aspect of this invention. the angled recess region 31 provides a much larger contact surface area than previously known designs which generally include gear teeth. Advantageously, this prevents damage to the device caused by bumping of the arm support or the like.

Forming the angled recess region 31 and substantially flat recess region 32 in the second plate 22 leaves two extended surfaces 36 which support the radial projections 23. In the present embodiment, the projections 23 are positioned adjacent the perimeter on a second side 37 of the plate 22. A center aperture 38 is also provided for receiving the fastener 27 that secures the arm support locking mechanism 14 together as shown in FIG. 3. In accordance with the broad teaching of the present invention, the first and second plates 20, 22 could be reversed in design such that the first plate includes projections and the second plate includes notches, or even a combination of notches and projections.

In a further attempt to minimize inadvertent damage to the arm support apparatus 10, distal ends 39 of the projections 23 are at least partially tapered and the notches 21 are shaped to receive the tapered distal ends of the projections in the preferred embodiment. In this manner, the projections 23 are more easily able to unseat from the notches 21 when a substantial force is applied to the arm support 12. Advantageously, this prevents the shearing off of one or more of the projections 23 when the arm support 12 is accidentally bumped or another substantial force is applied thereto.

Figure 7:
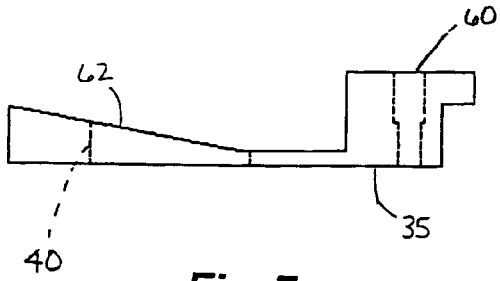
FIG. 7 is a side elevation view of a wedge-shaped member of the arm support locking mechanism.

Referring back to FIG. 1, a wedge-shaped member 35 is positioned between the first and second plates 20, 22 and engages the angled recess region 31 in a locked position for controlling the locking and unlocking of the first and second plates and movement of the arm support 12 as is described in more detail below. A generally oval-shaped aperture 40 is formed in the wedge-shaped member (shown in FIG. 7) through which the fastener 27 extends. The oval-shaped aperture 40 allows the wedge-shaped member 35 to slide between a first position wherein the first and second plates 20, 22 are engaged and the locking mechanism 14 is locked to a second unlocked position.

Figure 8:
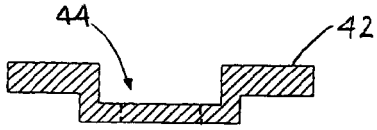
FIG. 8 is a side elevation view of a retention plate of the arm support locking mechanism.
Figure 11:
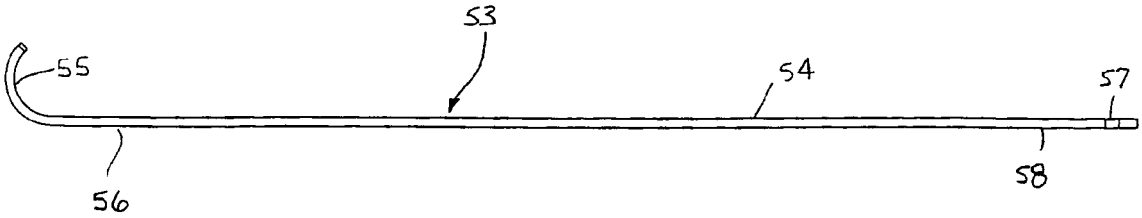
FIG. 11 is a side elevation view of a release member for moving the wedge-shaped member to unseat the projections from the notches in the unlocked position.

The present preferred arm support locking mechanism 14 further includes a retention plate 42 shown in FIG. 8. A spring or biasing member 43 positioned between the retention plate 42 and the second plate 22 biases the second plate to a locked position. In the locked position, the first and second plates 20, 22 are maintained in engagement and the arm support 12 cannot rotate. Although a recess 44 is shown in the present preferred retention plate 42 for receiving a head of the fastener 27, the retention plate could be flat or even counter sunk in accordance with the broad teaching of the present invention.

Figure 9:
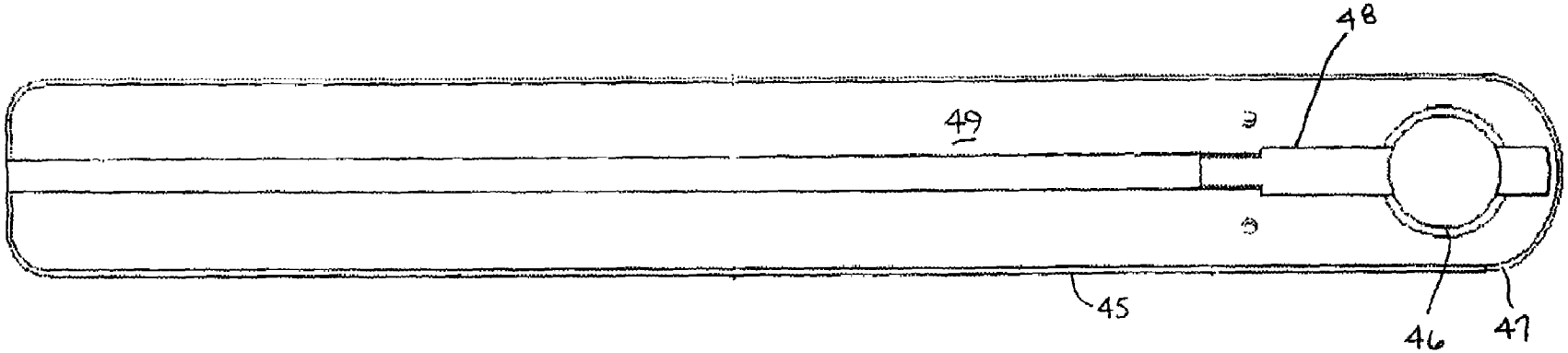
FIG. 9 is a top view of the base of the arm support showing a channel for slidably receiving the wedge-shaped member of the arm support locking mechanism.
Figure 10:
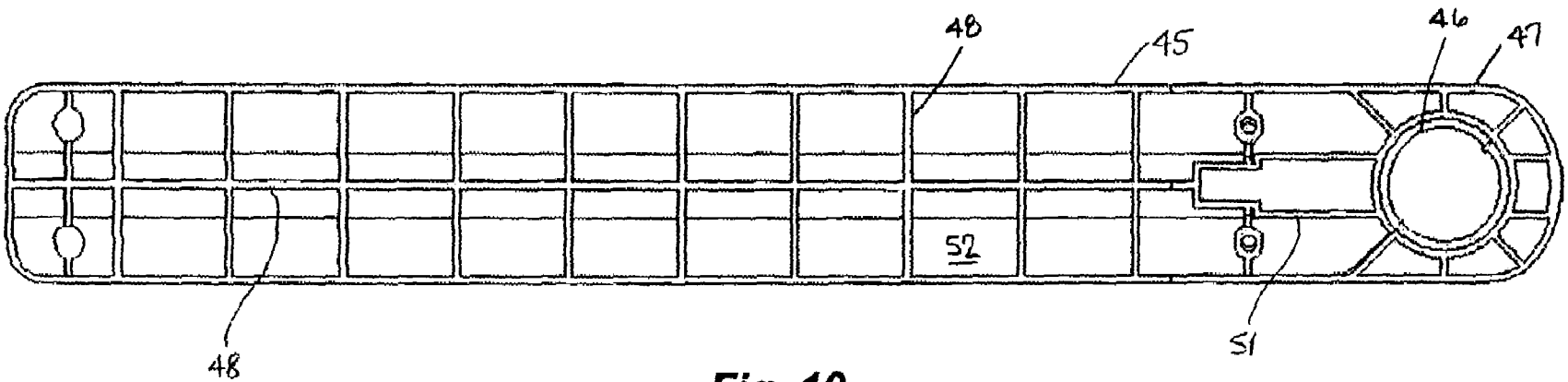
FIG. 10 is a bottom view of the base of the arm support showing another channel for slidably receiving a release member used to unseat the projections from the notches in the unlocked position.

The arm support 12 further includes a base 45, shown in FIGS. 1, 9 and 10. In the present preferred embodiment, the base 45 extends longitudinally at least partially along and supporting the arm support 12. In the embodiment shown in FIGS. 9 and 10, the base includes ribs 48 to provide additional strength.

As best seen in FIGS. 1 and 3, the arm support locking mechanism 14 extends through an aperture 46 formed in a distal end 47 of the base 45 such that the base is secured in position between the first and second plates 20, 22. A first channel 68 is formed in a top side 49 of the base 45 for slidably receiving the wedge-shaped member 35. A spring 50 (shown in FIG. 1) biases the wedge-shaped member 35 in the locked position. A second channel 51, shown in FIG. 10, is formed in a bottom side 52 of the base 45 for slidably receiving a release member 53.

The release member 53 is an elongated bar 54 with a hook 55 formed at one end 56 for grasping by an operator. An aperture 57 is formed in a second end 58. As best shown in FIG. 1, a locking pin 59 is press fit or otherwise secured in aperture 60 of the wedge-shaped member 35 and extends through aperture 57 of the release member 53. The locking pin 59 engages a plurality of protrusions 69 formed in the arm support 12 for securing the arm support in a desired position. The arm support 12 further includes first and second recesses 66, 67 which allow the arm support to rotate about an axis substantially coaxial with the patient's arm when the patient's arm is resting thereon.

In operation, the operator pulls the hook 55 with his finger overcoming the locking pin 59, and moving the release member 53 toward the operator. Movement of the release member 53 necessarily moves the wedge-shaped member 35 and disengages locking pin 59. More specifically, movement of the wedge-shaped member 35 and an angled surface 62 of the wedge-shaped member 35 which partially engages the angled recess region 31 of the second plate 22 in the locked position forces the second plate upward. This upward movement of the second plate 22 serves to unseat the projections 23 from the notches 21. In this unlocked position, the arm support 12 may be rotated about the locking mechanism 14 up to three-hundred sixty degrees and/or about an axis substantially coaxial with the patient's arm when resting on the arm support. Of course, releasing the release member 53 allows the projections 23 of the second plate 22 to re-engage the notches 21 of the first plate 20, and the locking pin 59 to re-engage the protrusions 69, thus locking the arm support 14 in the new position.

In the present preferred embodiment, shown in FIG. 1, the locking mechanism 14 is positioned at a distal end 65 of the arm support 12. The arm support 12 includes a curved bottom support supporting a curved cushion (not shown) for cradling the patient's arm during surgery. The cushion is preferably securely attached or removeably attached to the curved bottom support using an epoxy, hook and loop fasteners, or the like. Advantageously, the curvature in the bottom support and the cushion provides a larger surface area for supporting the patient's arm without increasing the overall width of the arm support 12. The curvature further allows the arm to be held in position without clasps or the like thus providing protection from pressure-related injuries caused by tapes or straps required to hold the arm. This is true regardless of the angle of the surgical table or chair.

The present preferred arm support 12 further includes first and second recesses 66, 67 which allow the arm support to rotate about an axis substantially coaxial with the patient's arm when the patient's arm is resting thereon. Accordingly, the patient may rest supine, semi-erect, or fully erect in a sitting or tilted position while the patient's arm rests comfortably in the curved arm support 12. Of course, it may be desirable to use supplemental straps or the like attached to the arm support 12 to secure the patient's arm in some positions but the curvature of the arm support 12 allows the contact of the strap with the arm to be minimized.

The foregoing description of the preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

The invention claimed is:

1. An apparatus for supporting a patient's arm in a desired position during surgery comprising:

a support for a patient;

an arm support for supporting the patient's arm;

an arm support locking mechanism including a first plate having at least one notch, a second plate having at least one projection adapted to seat in the at least one notch of said first plate in a locked position, one of said first and second plates having an angled recess region, a wedge-shaped member positioned between said first and second plates and engaging the angled recess region in the locked position, a retention plate, a biasing member positioned between said retention plate and one of said first and second plates, and a fastener extending at least partially through said retention plate, said first and second plates, and said wedge-shaped member, wherein movement of said wedge-shaped member moves one of said first and second plates against a force of said biasing member to unseat said at least one projection from the at least one notch in the unlocked position; and a bracket for attaching said arm support and said arm support locking mechanism to said support for a patient.

2. The apparatus for supporting a patient's arm in a desired position during surgery in claim 1, wherein said arm support is at least partially curved so as to cradle the patient's arm.

3. The apparatus for supporting a patient's arm in a desired position during surgery in claim 2, wherein said arm support is further rotatable about an axis substantially coaxial with the patient's arm when the patient's arm is resting on said arm support in the unlocked position.

4. The apparatus for supporting a patient's arm in a desired position during surgery in claim 1, further comprising a base extending longitudinally at least partially along and supporting said arm support, said base having a channel formed therein for slidably receiving said wedge-shaped member; and a release member for moving said wedge-shaped member to unseat said at least one projection from the at least one notch in the unlocked position.

5. The apparatus for supporting a patient's arm in a desired position during surgery in claim 4, further comprising a locking pin supported by said wedge-shaped member and engaging protrusions formed in said arm support in the locked position, wherein said release member unseats said locking pin allowing said arm support to further rotate about an axis substantially coaxial with the patient's arm when the patient's arm is resting on said arm support in the unlocked position.

6. The apparatus for supporting a patient's arm in a desired position during surgery in claim 1, wherein the one of said first and second plates having an angled recess region further includes a substantially flat recess region and at least one extended surface supporting one of said at least one notch or said at least one projection.

7. The apparatus for supporting a patient's arm in a desired position during surgery in claim 6, wherein the angled recess region extends from the substantially flat recess region to a first edge of the one of said first and second plates having an angled recess region.

8. The apparatus for supporting a patient's arm in a desired position during surgery in claim 7, wherein at least one of said first and second plates are substantially circular.

9. The apparatus for supporting a patient's arm in a desired position during surgery in claim 1, wherein a distal end of said at least one projection is tapered.

10. The apparatus for supporting a patient's arm in a desired position during surgery in claim 9, wherein the at least one notch is tapered to receive said tapered distal end of said at least one projection, whereby said at least one projection will unseat from the at least one notch when a substantial force is applied to the arm support to prevent damage to said at least one projection.

11. The apparatus for supporting a patient's arm in a desired position during surgery in claim 10, wherein said arm support is at least partially curved so as to cradle the patient's arm.

12. The apparatus for supporting a patient's arm in a desired position during surgery in claim 11, wherein said arm support is rotatable about an axis substantially coaxial with the patient's arm when the patient's arm is resting on said arm support.

13. The apparatus for supporting a patient's arm in a desired position during surgery in claim 10, further comprising a base extending at least partially along and supporting said arm support, said base having a channel formed therein for slidably receiving said wedge-shaped member; and a release member for moving said wedge-shaped member to unseat said at least one projection from the at least one notch in the unlocked position.

14. An arm support locking mechanism for securing an arm support in a desired position during surgery comprising:

a first plate having at least one notch;

a second plate having at least one projection adapted to seat in the at least one notch of said first plate in a locked position;

one of said first and second plates having an angled recess region;

a wedge-shaped member positioned between said first and second plates and engaging the angled recess region in the locked position;

a retention plate;

a spring positioned between said retention plate and one of said first and second plates; and a fastener extending at least partially through said retention plate, said first and second plates, and said wedge-shaped member wherein movement of said wedge-shaped member moves one of said first and second plates against a force of said spring to unseat said at least one projection from said at least one notch in an unlocked position.

15. The arm support locking mechanism for securing an arm support in a desired position during surgery in claim 14, wherein said second plate includes the angled recess region, a substantially flat recess region, and at least one extended surface supporting said at least one projection.

16. The arm support locking mechanism for securing an arm support in a desired position during surgery in claim 15, wherein the angled recess region of said second plate extends from the substantially flat recess region to a first edge of said second plate.

17. The arm support locking mechanism for securing an arm support in a desired position during surgery in claim 16, wherein at least one of said first and second plates are substantially circular.

18. The arm support locking mechanism for securing an arm support in a desired position during surgery in claim 14, wherein a distal end of said at least one projection is tapered, whereby said at least one projection will unseat from the at least one aperture when a substantial force is applied thereto.

19. An apparatus for supporting a patient's arm in a desired position during surgery comprising:

an arm support, said arm support being at least partially curved so as to cradle the patient's arm, and rotatable about an axis substantially coaxial with the patient's arm when the patient's arm is resting on said arm support;

an arm support locking mechanism attached to said arm support, said arm support locking mechanism having a first plate having at least one projection, a second plate having at least one notch adapted to receive said at least one projection of said first plate in a locked position, one of said first and second plates having an angled recess region, a wedge-shaped member positioned between said first and second plates and engaging the angled recess region in the locked position, a retention plate, a spring positioned between said retention plate and the one of said first and second plates having an angled recess region, and a fastener extending at least partially through said retention plate, said first and second plates, and said wedge-shaped member, wherein movement of said wedge-shaped member against a force of said spring unseats said at least one projection from the at least one notch in an unlocked position.

20. The apparatus for supporting a patient's arm in a desired position during surgery in claim 19, wherein said arm support locking mechanism further includes a locking pin supported by said wedge-shaped member and engaging protrusions formed in said arm support in the locked position, wherein movement of said release member unseats said locking pin allowing said arm support to rotate about the axis substantially coaxial with the patient's arm when the patient's arm is resting on said arm support in the unlocked position.

* * * * *